US006354017B1

(12) United States Patent
Bertoldo

(10) Patent No.: US 6,354,017 B1
(45) Date of Patent: Mar. 12, 2002

(54) APPARATUS AND METHOD FOR HEATSETTING A KNITTED FABRIC IN TUBULAR FORM

(75) Inventor: Franco Bertoldo, Brogliano (IT)

(73) Assignee: Sperotto Rimar S.p.A., Milan (IT)

( * ) Notice: Subject to any disclaimer, the term of this patent is extended or adjusted under 35 U.S.C. 154(b) by 0 days.

(21) Appl. No.: 09/571,933

(22) Filed: May 16, 2000

(30) Foreign Application Priority Data

May 25, 1999 (IT) ..... M199A1151

(51) Int. Cl.[7] ..... F26B 13/02
(52) U.S. Cl. ..... 34/115; 26/81
(58) Field of Search ..... 34/442, 443, 444, 34/448, 454, 115, 646; 26/81, 18.5

(56) References Cited

U.S. PATENT DOCUMENTS 3,585,696 A 6/1971 Aronoff
3,909,890 A * 10/1975 Frezza ..... 26/56
4,134,188 A * 1/1979 Bryan ..... 26/18.5
4,146,946 A * 4/1979 Plaia et al. ..... 26/18.5
4,155,227 A * 5/1979 Conti ..... 68/13
4,430,779 A * 2/1984 Rockman et al. ..... 26/18.5
4,541,156 A * 9/1985 Walsh et al. ..... 26/81
4,562,627 A * 1/1986 Milligan ..... 26/18.5
5,884,376 A * 3/1999 Bertoldo ..... 26/80

FOREIGN PATENT DOCUMENTS

DE 1 635 363 A 3/1972
WO 80/01084 5/1980

* cited by examiner

*Primary Examiner*—Ira S. Lazarus
*Assistant Examiner*—Greg T. Warder
(74) *Attorney, Agent, or Firm*—Nixon & Vanderhye, P.C.

(57) ABSTRACT

An apparatus for heatsetting a knitted fabric in tubular form comprises flat expansion means which extend the tubular fabric in substantially flattened form, with two superimposed surfaces, and cause said fabric to assume a preselected width, conveying means which feed said flattened tubular fabric, heatsetting elements which form at least one air flow, at a preselected temperature, and guiding rods associated with the conveying elements and the heatsetting elements; the rods being capable of supporting internally the flattened tubular fabric along its side edges, owing to the action of the heatsetting elements, while keeping the side edges extended, leaving the two superimposed surfaces free to be passed through by the air flow and keeping the width of the flattened tubular fabric unchanged.

20 Claims, 7 Drawing Sheets

APPARATUS AND METHOD FOR HEATSETTING A KNITTED FABRIC IN TUBULAR FORM

FILED OF THE INVENTION

This application is based on application No. MI99A 001151 filed in Italy, the content of which is incorporated hereinto by reference.

RELATED ART AND OTHER CONSIDERATIONS

The present invention relates to an apparatus and a method for heatsetting a knitted fabric in tubular form.

Circular knitted fabrics, depending on the circumstances, may be required to undergo successive processing operations for the preparation, dyeing, finishing and making-up thereof both in tubular form, as they descend from the circular knitting machine, and in an open form, obtained by cutting the tubular fabric along one of its side edges.

Generally, before undergoing wet treatments such as, for example, dyeing, the fabric is subjected, depending on the type or types of fibre which form it, to a heatsetting operation.

Heatsetting is performed, in particular, on fabrics composed of or partly containing synthetic fibres, such as thermoplastic fibres. The aim of heatsetting is to fix the dimensions and the flat state of the surfaces of the fabrics for providing them with stability and not cause permanent creases or distortions during the course of processing in bleaching and dyeing machines.

With the heatsetting machines which are currently available it is not possible to differentiate between the processing of fabrics with an orthogonal pattern, i.e. of the weft/warp type, and the processing of knitted fabrics in general, and it also necessary for the knitted fabrics to be in an open form.

This results in an increase in the duration of the processing cycle due to cutting and opening of the tubular fabric for heatsetting and, sometimes, re-stitching of the fabric in a tubular form for the bleaching/dyeing operation, followed by reopening for the finishing and making-up operation.

Moreover, these machines are unable to perform the heatsetting of circular knitted fabrics which must be completely processed in tubular form either for technical reasons or for cost-related reasons or because of market requirements.

On the other hand, processing in tubular form without heatsetting results in considerable risks from the point of view of quality and is only performed in exceptional cases.

Hitherto various attempts have been made to develop specific machines for heatsetting fabrics in tubular form. However, the results obtained are somewhat unsatisfactory. The known machines are characterized essentially by the method of conveying and guiding the tubular fabric and by the system for transferring heat to the fabric.

In some machines, the tubular fabric is guided by means of a flat expansion device and is fed in a flattened form between the surface of a heated steel cylinder and an endless felt belt. The main drawbacks of these machines consist in the squashing of the side edges of the tubular fabric and a non-uniform heat exchange on its two surfaces.

In other machines, the tubular fabric is guided by means of a flat expansion device which accompanies it in a flattened form through a horizontal or vertical chamber until it emerges therefrom. Inside the chamber, the two surfaces of the tubular fabric are acted on by flows of hot air. In this case, squashing of the side edges of the fabric does not occur, but, during conveying, the fabric is subject to undesirable elongation. Moreover, the heat exchange on the two surfaces of the fabric is inadequate.

SUMMARY

An object of the present invention is to avoid the drawbacks and overcome the limitations of the known machines for heatsetting fabrics in tubular form.

According to a first aspect thereof, the invention relates to an apparatus for heatsetting a knitted fabric in tubular form, comprising:

a) means for feeding said tubular fabric, b) steam-treatment means designed to direct steam onto said tubular fabric, c) first flat expansion means capable of extending said tubular fabric in a substantially flattened form, with two superimposed surfaces, and causing said flattened tubular fabric to assume a preselected width, d) conveying means capable of feeding said flattened tubular fabric, e) heatsetting means capable of forming at least one air flow, at a preselected temperature, and associated with said conveying means, and f) means for stabilizing said heatset tubular fabric, characterized in that it comprises:

g) rod-shaped guiding means associated with said conveying means and said heatsetting means, said rod-shaped means being capable of supporting internally said flattened tubular fabric along its side edges, owing to the action of said heatsetting means, while keeping the said side edges extended, leaving said superimposed surfaces free to be passed through by said air flow and keeping said width of said flattened tubular fabric unchanged.

Preferably, the apparatus also comprises second flat expansion means, said first flat expansion means and said second flat expansion means being located respectively upstream and downstream of said conveying means, said second flat expansion means being capable of keeping said tubular fabric in a substantially flattened form, with two superimposed surfaces, while maintaining said preselected width, said rod-shaped means being connected to said first and second flat expansion means for assuming a mutual distance, equal to said width of said flattened tubular fabric.

Advantageously, said heatsetting means are capable of directing said air flow towards said flattened tubular fabric for passing through and strike said two superimposed surfaces.

According to a preferred embodiment, said conveying means comprise a drum having a cylindrical side wall onto which said flattened tubular fabric is wound, said drum being capable of feeding said fabric with positive driving, without applying a longitudinal tension, said rod-shaped means being formed by two rods with a curvilinear cross-section and substantially annular form, associated with said drum for supporting internally said side edges of said tubular fabric wound onto said cylindrical side wall.

Advantageously, said two substantially annular rods are integral with said first and second flat expansion means for assuming said mutual distance, and slider means are associated with said two rods for keeping them at said mutual distance with respect to said cylindrical side wall.

Preferably, said cylindrical side wall of said drum is perforated and said heatsetting means form substantially radial air flows, at a preselected temperature, capable of passing through said perforated wall and passing through and striking said two superimposed surfaces of said flattened tubular fabric for performing said heatsetting while said tubular fabric is wound onto said perforated drum.

According to another embodiment, said conveying means comprise two conveyor belts which are facing each other and between which said flattened tubular fabric is arranged, said two conveyor belts being capable of feeding said fabric with positive driving, without applying a longitudinal tension, said rod-shaped means being formed by two substantially straight rods with a curvilinear cross-section, associated with said conveyor belts for supporting internally said side edges of said tubular fabric arranged between said conveyor belts.

Preferably, said two substantially straight rods are integral with said first and second flat expansion means for assuming said mutual distance.

Advantageously, said conveyor belts are perforated and said heatsetting means form opposing air flows, at a preselected temperature, capable of passing through said perforated belts and passing through and striking said two superimposed surfaces of said flattened tubular fabric for performing said heatsetting while said tubular fabric is arranged between said perforated belts.

According to a second aspect, the invention relates to a method for heatsetting a knitted fabric in tubular form, comprising the steps of:

i) treating said tubular fabric with steam, ii) expanding said tubular fabric, extending it in a substantially flattened form, with two superimposed surfaces, and causing said flattened tubular fabric to assume a preselected width, iii) conveying said flattened tubular fabric, iv) heatsetting said flattened tubular fabric during conveying thereof, by means of at least one air flow, at a preselected temperature, and v) stabilizing said heatset tubular fabric, characterized in that vi) said flattened tubular fabric is supported internally along its side edges during said heatsetting, while keeping said side edges extended and leaving said superimposed surfaces free to be passed through by said air flow and keeping said width of said flattened tubular fabric unchanged.

Preferably, said heatsetting air flow passes through and strikes said two superimposed surfaces of said flattened tubular fabric.

Advantageously, said conveying of said flattened tubular fabric is performed with positive driving, without applying a longitudinal tension thereto.

The apparatus and the method according to the invention offer numerous advantages.

Principally, they allow the side edges of the tubular fabric to be supported internally, protecting them during the critical phase of heatsetting. The risks of adversely affecting and rendering unacceptable the quality of the processed tubular fabric are thus minimised.

With the apparatus and the method according to the invention, there is also a very high, efficient and uniform heat exchange between air and fabric because it is performed on both surfaces of the fabric, owing to the forced flow of air through the fabric.

Moreover, driving of the fabric is always positive in any zone of the fabric path and between one zone and another. In particular, the fabric is never driven with a longitudinal pulling force.

Therefore, the transverse and longitudinal dimensions of the fabric are defined and maintained in each zone of the apparatus.

All this improves the quality of the product.

The conditions of:

protection of the side edges of the tubular fabric, efficient and uniform transfer of heat to the two surfaces of the tubular fabric, and positive driving of the tubular fabric without longitudinal pulling, resulting in the transverse and longitudinal dimensions being maintained in each zone of the apparatus, are never obtained in known machines.

BRIEF DESCRIPTION OF THE DRAWINGS

Characteristic features and advantages of the invention will now be illustrated with reference to embodiments shown by way of a non-limiting example in the accompanying drawings in which.

DETAILED DESCRIPTION

Figure 1:
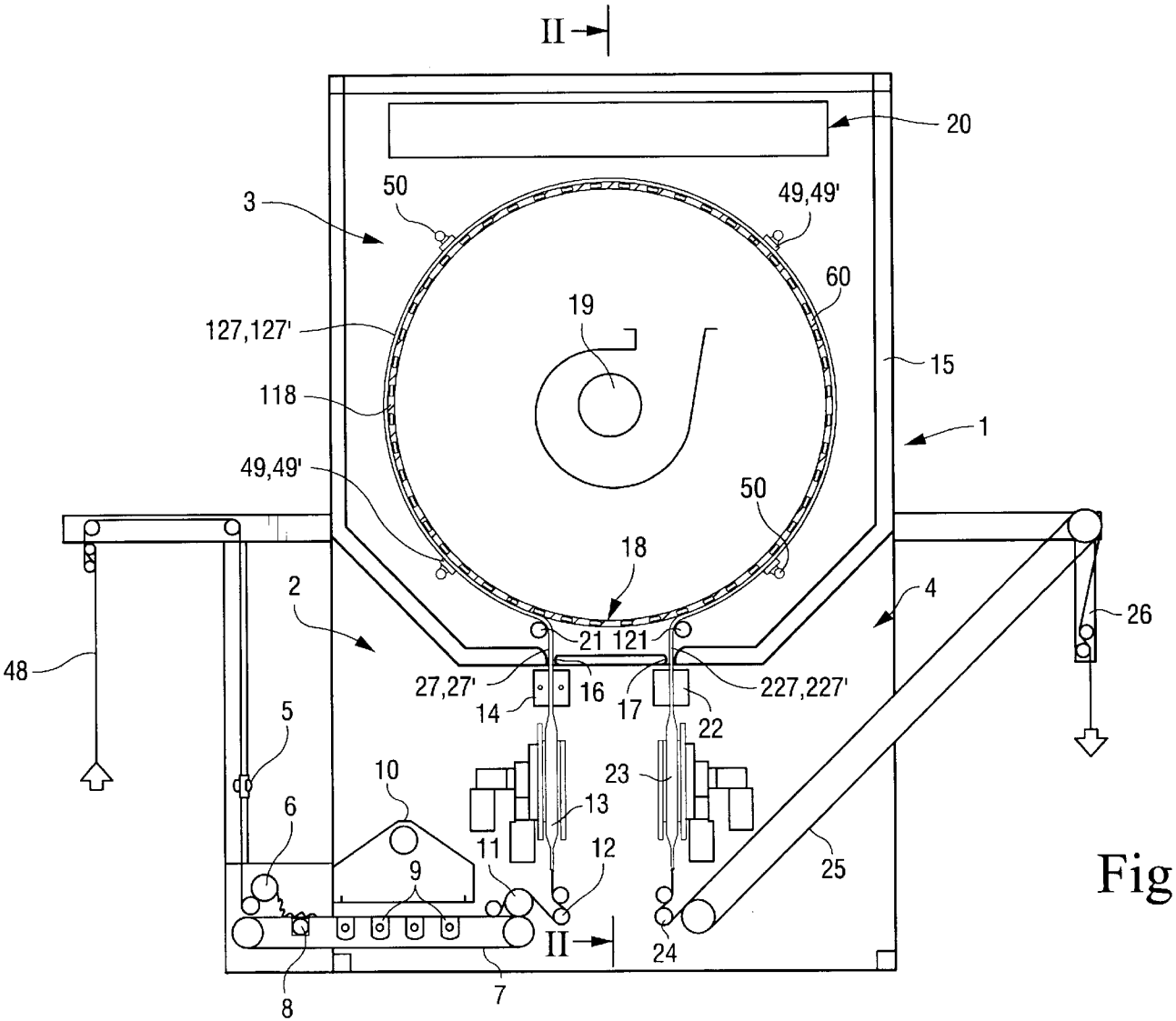
FIG. 1 is a partially sectioned side view of an apparatus for heatsetting a knitted fabric in tubular form, provided in accordance with the invention.

FIG. 1 shows an apparatus 1 for heatsetting a knitted fabric 48 in tubular form. The apparatus 1 comprises a fabric entry zone 2, a heatsetting chamber 3 and an exit zone 4.

The entry zone 2 contains an annular expansion device 5 designed to perform preliminary extension of the tubular fabric 48, a motorized drive roller 6 for guiding the tubular fabric and a conveyor belt 7. The conveyor belt 7 has, associated with it, a vibrator 8, steam delivery pipes 9 and a suction hood 10. The entry zone 2 also contains a motorized drive roller 11 for guiding the tubular fabric 48, an electronic load cell 12 designed to monitor the tension of the tubular fabric, a motorized entry expansion device 13 and steam slide boxes 14. The expansion device 13 has two shaped end rods 27 and 27' with a curvilinear, in particular circular, cross-section (FIG. 4) which extend beyond the slide boxes 14 and the function of which will be described further below.

Figures 2, 3:
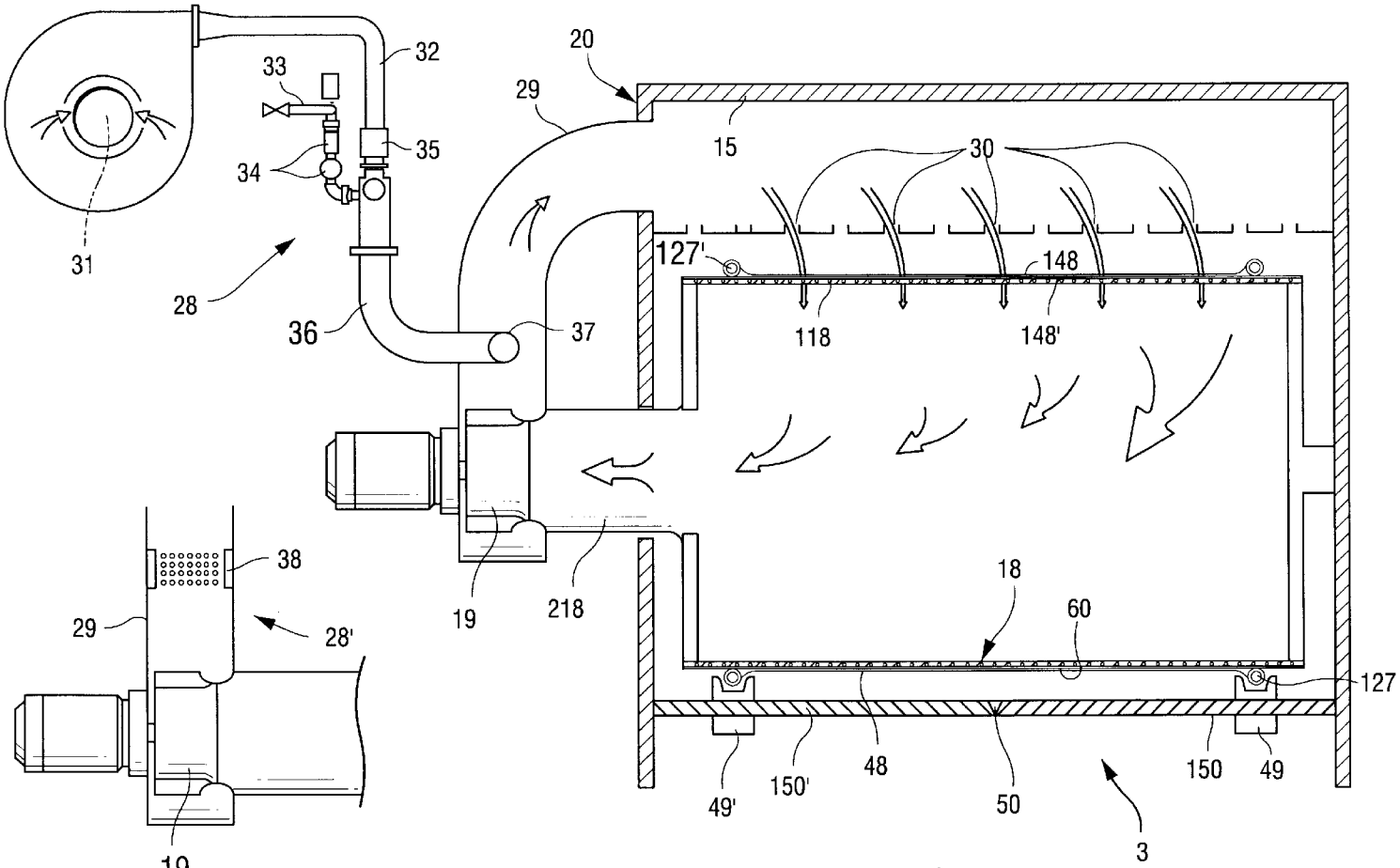
FIG. 2 is a partially sectioned view, on a larger scale, along the plane indicated by II—II in FIG. 1.
FIG. 3 shows a variation of an air heater of a heatsetting chamber according to FIG. 2.

The heatsetting chamber 3 has a housing 15 provided with an entry slit 16 for the tubular fabric 48 and an exit slit 17 for the tubular fabric. A drive roller 21 guides the tubular fabric 48, emerging from the slit 16, for being wound onto a motorized rotating drum 18, and a drive roller 121 guides the tubular fabric which is unwound from the drum 18 towards the exit slit 17. The drum 18 has a perforated cylindrical side wall 118 lined with a layer of non-woven fabric 60. The drum 18 is provided with a hollow shaft 218 connected to a suction device 19. The suction device 19 is connected, in turn, by means of a delivery duct 29, to a container 20 provided with openings 30 for distributing the air, at a preselected temperature, inside the chamber 3 (FIG. 2).

The exit zone 4 of the apparatus 1 contains cooling-air slide boxes 22, a motorized exit expansion device 23, an electronic load cell 24, a conveyor belt 25 and a plaiting device 26. The expansion device 23 is provided with two shaped end rods 227 and 227' with a curvilinear, in particular circular, cross-section, which extend beyond the slide boxes 22 and the function of which will be described further below.

The expansion device 13, which is located upstream of the drum 18, comprises (FIG. 4) a support base 39 which houses a threaded spindle 40, provided with two oppositely wound threads 140 and 140', and a pair of support plates 41 and 41' which have, integral with them, sliders, not shown, which engage with the spindle 40. Each plate 41, 41' supports a respective pair of motorized wheels 42, 43 and 42', 43' and a respective extension element 44, 44' which engages with the respective wheels 42, 43 and 42', 43' by means of contact with travel elements comprising belts combined with pairs of roller wheels 45, 46 and 45', 46'. The shaped rod 27 is integral with the extending element 44, while the shaped rod 27' is integral with the extending element 44'.

The expansion device 23, located downstream of the drum 18, has the same structure as the expansion device 13 and is a mirror-image with respect thereto. However, its motorized wheels rotate in an opposite direction to that of the motorized wheels of the expansion device 13.

Figure 4:
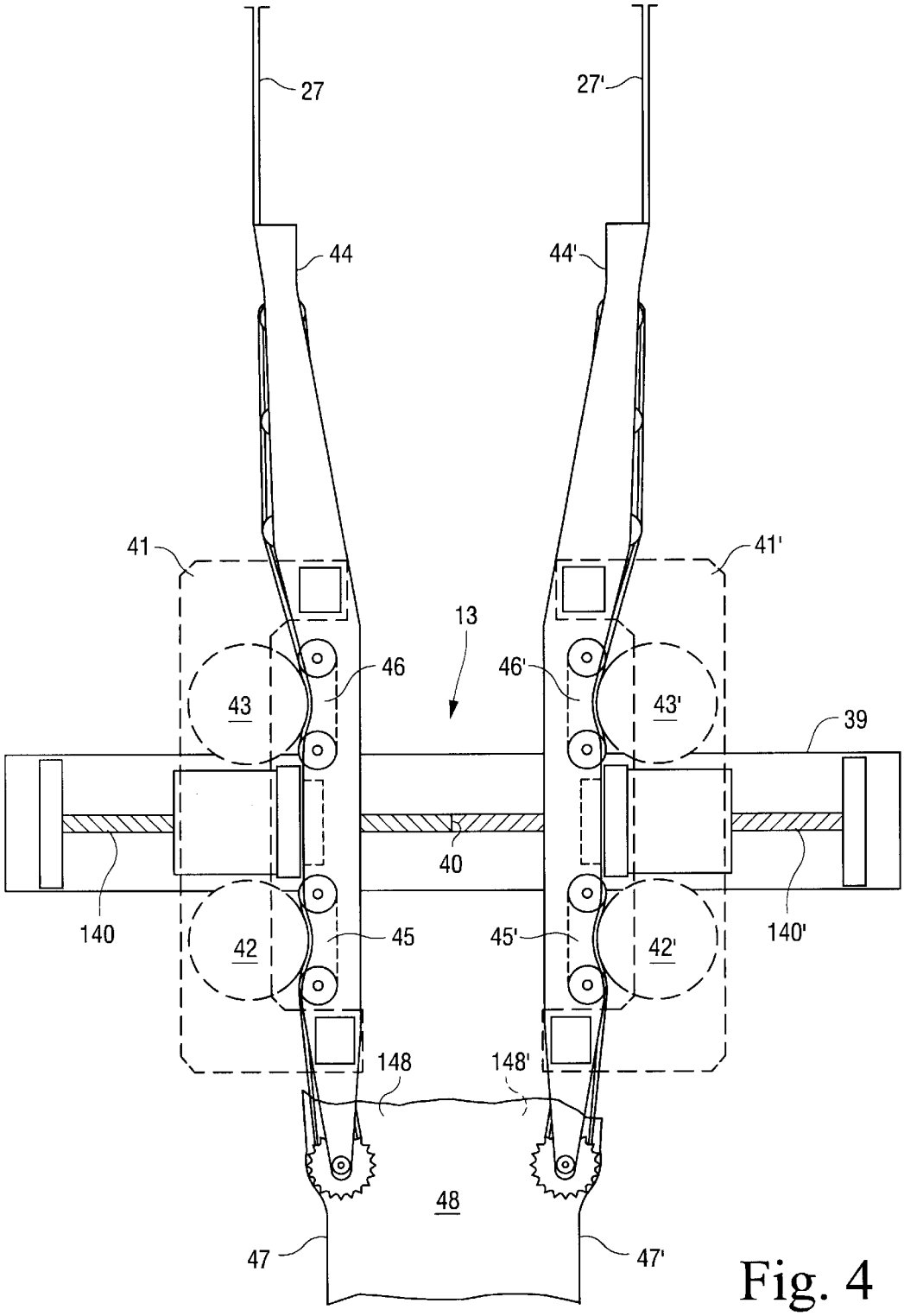
FIG. 4 is a partially sectioned front view, on a larger scale, of an expansion device of the apparatus according to FIG. 1.

The drum 18 has, associated with it, two substantially flexible rods 127 and 127' with a curvilinear, in particular circular, cross-section. The rods 127 and 127' have a substantially annular shape, are coaxial with the side wall 118 of said drum and are spaced at a distance of about 5 mm therefrom. The annular rod 127 is integral with the two shaped end rods 27 and 227 of the two entry and exit expansion devices 13 and 23 and forms an elastic connection between the two rods 27 and 227; in turn, the annular rod 127' is integral with the two shaped end rods 27' and 227' of the two entry and exit expansion devices 13 and 23 and forms an elastic connection between the two rods 27' and 227'. The two annular rods 127 and 127' engage with side edges 47 and 47' of the tubular fabric 48 (FIGS. 2 and 4). Said rods have the function of supporting internally the flattened tubular fabric along its side edges 47 and 47' during heatsetting, keeping the side edges in an extended and rounded form and leaving its two superimposed surfaces 148, 148' free to be passed through by the heatsetting air and leaving unchanged the width of the flattened tubular fabric set in the expansion devices 13 and 23.

Figure 5:
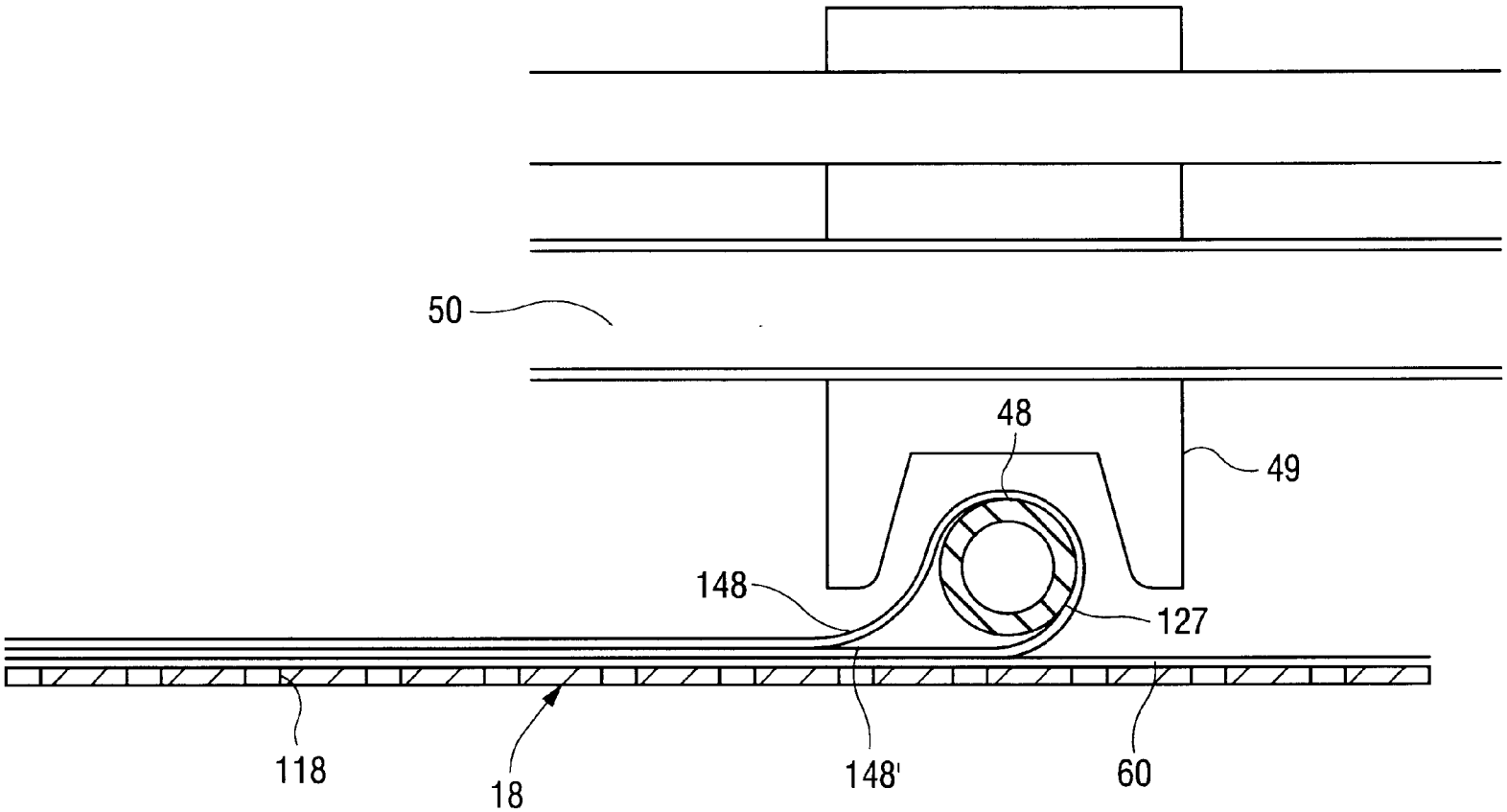
FIG. 5 is a view, on a larger scale, of a slider for guiding an annular rod of the apparatus according to FIG. 1.

The two annular rods 127 and 127' assume a mutual distance, which is maintained by four pairs of sliders 49 and 49' depending on the width of the tubular fabric 48 set in the expansion devices 13 and 23. The sliders 49 and 49' guide, by means of contact, the annular rods 127 and 127', assisting sliding thereof with respect to the side wall 118 of the drum 18, performed by the expansion devices 13 and 23. Each pair of sliders 49 and 49' is operationally connected to a threaded spindle 50 provided with two oppositely wound threads 150 and 151 (FIGS. 3 and 5). Each spindle 50 is rotated, by means of a transmission, not shown, synchronized with the expansion devices 13 and 23.

Figure 6:
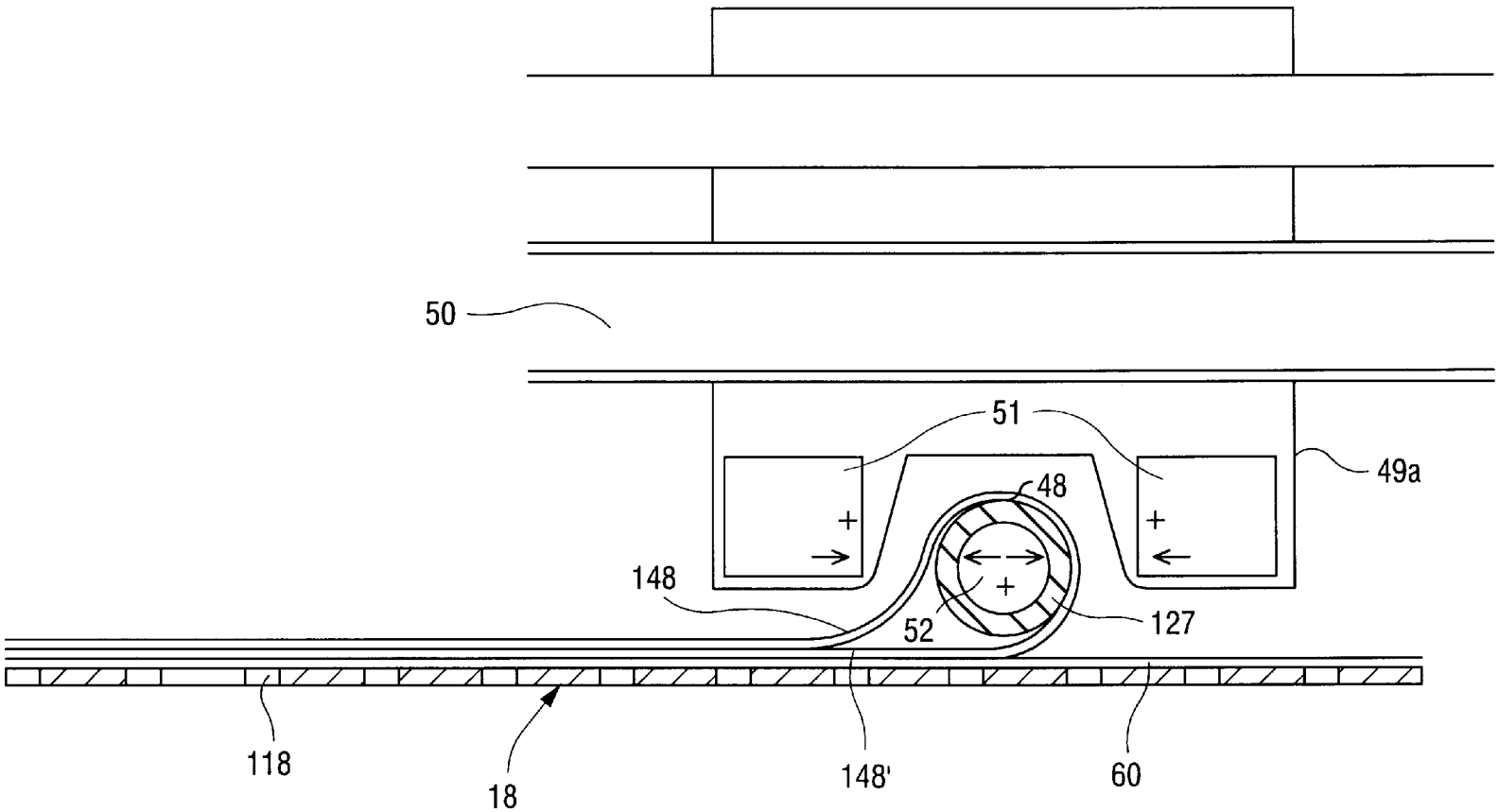
FIG. 6 is a variant of the slider according to FIG. 5.

FIG. 6 shows a magnetic slider 49*a* which is a variant of the slider 49 according to FIG. 5. The slider 49*a* is provided with two bipolar magnets 51 associated with two bipolar magnets 52 which are incorporated in the annular rod 127. The repulsive force which is exerted between the magnets 51 and 52 allows the slider 49*a* to guide the annular rod with respect to the drum 18 without there being any contact between slider and rod.

Inside the heatsetting chamber 3 (FIG. 2) the suction device 19 produces a flow of air through the container 20, the openings 30, the perforated wall 1 18 of the drum 18, the inside of the drum 18 and the hollow shaft 218. The air which flows through the duct 29 is heated by means of a heating unit of the direct gas type. The heating unit 28 comprises a fan 31, an air pipe 32, a gas feeder 33, a gas flow regulator 34, a burner 35 and a pipe 36 for the combustion fumes, which emerges inside the duct 29 by means of nozzles 37.

FIG. 3 shows a heating unit 28', of the diathermic oil type, which is a variant of the heating unit 28 according to FIG. 2. Said heating unit comprises a heat exchanger 38 supplied with diathermic oil and arranged inside the delivery duct 29 of the fan 19.

When the apparatus 1 is in operation, the circular knitted fabric 48, which is in tubular form, is fed to the entry zone where it is extended beforehand by means of the annular expansion device 5 (FIG. 1). Then, the tubular fabric 48 is conveyed by means of the drive roller 6 which feeds it bunched in the form of small pleats onto the conveyor belt 7. On the belt 7 the fabric is made to vibrate by the vibrator 8 and is subject to an intense steam treatment by means of the steam emitted from the pipes 9, for providing it with the desired density. After said operation, the tubular fabric 48 is unloaded from the belt 7 by means of the drive roller 11 and is conveyed to the entry expansion device 13 via the load cell 12 which monitors the tension of the fabric. Within the expansion device 13, the tubular fabric 48 is threaded (FIGS. 1 and 4) by means of the extending elements 44 and 44' which are inserted inside said fabric, making contact with its side edges 47 and 47'. In this way the tubular fabric assumes a substantially flattened form with its surfaces 148, 148' superimposed. The side edges 47 and 47' of the flattened tubular fabric travel along the extension elements 44 and 44' in the zone lying between the travel elements 45, 46 and 45', 46' and the wheels 42, 43 and 42', 43'. As a result, the flattened tubular fabric 48 is fed with positive driving and without being pulled.

In order to vary and adjust the width of the flattened tubular fabric 48, the plates 41 and 41' which carry the extension elements 44 and 44' are mutually displaced towards and away from each other on the base 39 by means of operation of the threaded spindle 40.

In order to vary and adjust the longitudinal overfeeding of the flattened tubular fabric 48, the drive wheels 42, 43 and 42', 43' are made to rotate at a speed greater than that of the following rotating drum 18 for feeding said tubular fabric towards said drum in a variably bunched form. At the exit of the expansion device 13, the tubular fabric is kept in a substantially flattened form by the rods 27 and 27' which engage with its side edges 47 and 47'.

The tubular fabric 48 is then guided, in preset width and overfeeding conditions, for passing between the steam slide boxes 14 and then be deposited onto the rotating drum 18. The annular rods 127 and 127', which engage with the side edges 47 and 47' of the tubular fabric 48 accompany the latter over the entire path around the drum 18.

The flattened tubular fabric 48, while it is wound onto the drum 18 and transported by the latter, guided by the annular rods 127 and 127', is passed through by the substantially radial air flow produced by the fan 19. The fan 19 sucks in air from inside the drum and recirculates it, via the duct 29, to the container 20 which, in turn, distributes it inside the chamber 3, via the openings 30, directing the air towards the tubular fabric and the perforated side wall 118 of the drum 18. The recirculated air, which passes through the duct 29, is heated to the predetermined temperature by means of the heating unit 28 or 28'. As a result, the hot air passes through and strikes the two superimposed surfaces 148, 148' of the flattened tubular fabric, ensuring an optimum heatsetting treatment.

After heatsetting treatment, the tubular fabric 48 is unwound from the drum 18 and guided, under controlled tension conditions, towards the exit slit 17. The tubular fabric 48 is then inserted, via the cooling slide boxes 22, onto the shaped rods 227 and 227' for being threaded into the exit expansion device 23 and be deposited, after monitoring of the tension by the load cell 24, onto the conveyor belt 25. Finally, the tubular fabric 48 is collected in folds by means of the plaiting device 26.

In the apparatus 1 described, the annular rods 127 and 127' which are associated with the drum 18 and which engage internally with the side edges 47 and 47' of the tubular fabric 48 enable a twofold advantage to be obtained: a) they allow the width of the tubular fabric previously set by means of the expansion devices 13 and 23 to be kept unchanged; and b) they keep the side edges of the tubular fabric in an extended and rounded form, preventing them from being flattened on the surface of the rotating drum and preventing the permanent fixation of lateral creases.

In order to perform this latter fundamentally important function, the annular rods 127 and 127' do not rest on the side wall 118 of the drum 18, but are raised and located at a preselected distance (about 5 mm) therefrom. Thus, they keep the side edges of the tubular fabric extended and detached from the side wall of the drum.

The pairs of sliders 49 and 49', which are actuated by the threaded spindles 50, or the magnetic sliders, such as 49*a*, which guide the relative displacement of the annular rods 127 and 127' with respect to the side wall 118 of the drum 18, assist the corresponding relative displacement of the shaped rods 27, 27' and 227 and 227', performed by the expansion devices 13 and 23. For this purpose, the transmission which actuates the threaded spindles 50 is synchronized with those of the expansion devices 13 and 23. It is thus possible to adjust the mutual distance between the annular rods 127 and 127' in relation to the width of the tubular fabric set by means of the expansion devices 13 and 23.

Figure 7:
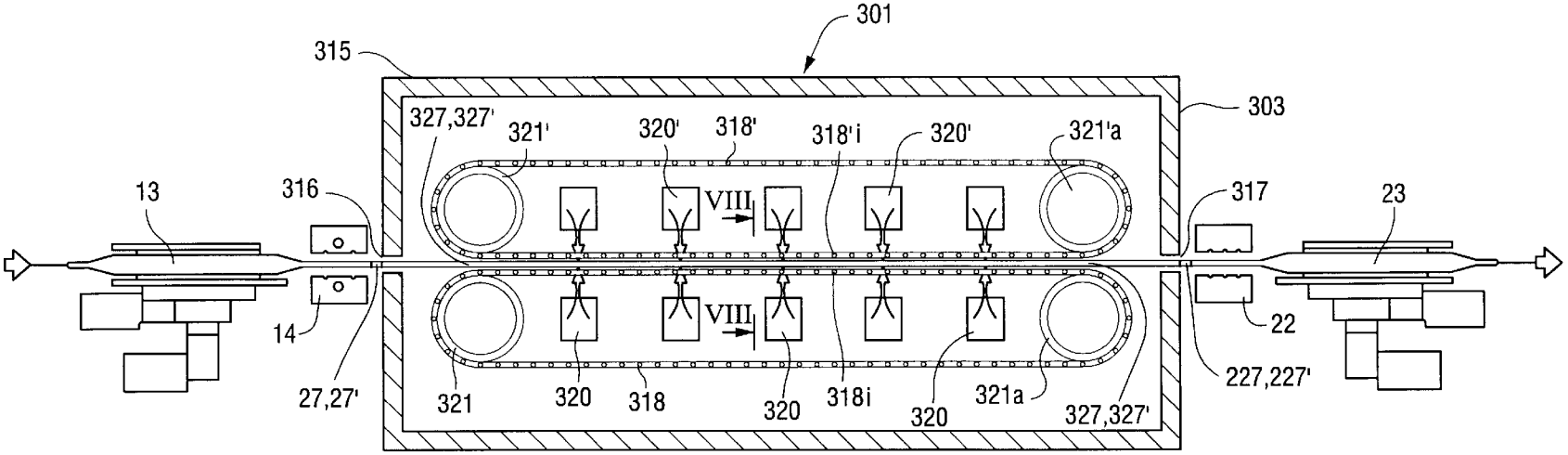
FIG. 7 is a longitudinally sectioned view of a variant of the heatsetting apparatus according to FIG. 1.
Figure 8:
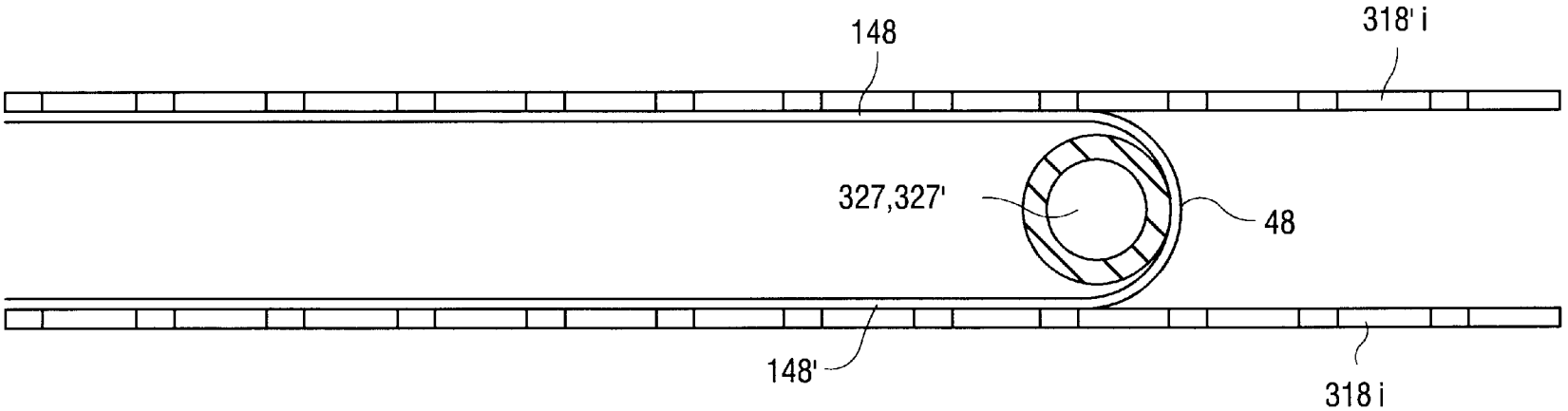
FIG. 8 is a partially sectioned view, on a larger scale, along the plane indicated by VIII—VIII FIG. 7.

FIG. 7 shows an apparatus 301 which is a variant of the apparatus 1 according to FIG. 1 and in which parts identical to those of the apparatus 1 are indicated by the same numbers.

The apparatus 301 comprises an entry zone 2 and an exit zone 4 similar to those of the apparatus 1. FIG. 7 shows the entry expansion device 13 and the steam slide boxes 14 of the entry zone 2 and the exit expansion device 23 and the air slide boxes 22 of the exit zone 4.

The apparatus 301 comprises a heatsetting chamber 303 extending in a horizontal plane. The heatsetting chamber 303 has a housing 315 with entry slits 316 and exit slits 317, which houses a pair of perforated conveyor belts 318 and 318', respectively a lower conveyor belt and an upper conveyor belt, facing each other. The conveyor belt 318 is wound between a motorized cylinder 321*a* and an idle cylinder 321; the conveyor belt 318' is wound between a motorized cylinder 321'*a* and an idle cylinder 321'. Opposite groups of containers 320 and 320' for blowing and distributing air at a preselected temperature are associated with the internal sections 318*i* and 318'*i* of the conveyor belts 318 and 318'. The containers 320 and 320' are connected to a fan, not shown, which sucks air from inside the chamber 303 and recirculates it, by means of a pipe, not shown, to the containers.

The respective end rods 27, 227 and the 27', 227 of the expansion devices 13 and 23, located upstream and downstream of the conveyor belts 318 and 318', respectively, are connected by means of two substantially rigid rods 327 and 327' which have a curvilinear, in particular circular, cross-section. The rods 327 and 327' are substantially straight and parallel. The rods 327 and 327' are located between the mutually facing internal sections 318*i* and 318'*i* of the conveyor belts 318 and 318'.

Within the apparatus 301, the tubular fabric 48 is threaded into the expansion device 13 and fed with positive driving towards the steam slide boxes 14 until it is deposited between the internal sections 318*i* and 318'*i* of the conveyor belts 318 and 318' feeding it. The containers 320 and 320' direct flows of hot air towards the perforated conveyor belts. The air thus passes through the perforated belts 318 and 318' and passes through and strikes the two superimposed surfaces 148, 148' of the tubular fabric 48 which is located between them.

The parallel and straight rods 327 and 327' are arranged inside the tubular fabric and accompany it over the whole travel path between the conveyor belts 318 and 318', supporting it along its side edges. The rods 327 and 327' thus allow the previously set width of the tubular fabric to be kept unchanged and the side edges of the said fabric to be kept in an extended and rounded form, preventing them from being squashed and preventing creasing of the lateral folds from occurring.

With the heatsetting method according to the invention, circular knitted fabrics are processed in tubular form. In particular, the fabrics consist of synthetic fibres, such as thermoplastic fibres, or in any case fabrics containing variable quantities of synthetic fibres blended with natural or artificial fibres. For example, the fabrics may be composed of polyester and polyamide fibres, either separately or blended with cotton; blends of polyester and polyamide fibres with polyurethane elastomer fibres; blends of cotton and viscose with polyurethane elastomer fibres.

The tubular fabric is prepared initially with relaxation and shrinkage performed by means of free and tensionless steam-treatment, in order to increase the density of the stitches and, consequently, the weight of the fabric, thus achieving the required gram weight per $m^2$. Then, the required width of the tubular fabric is also defined.

Subsequently, the tubular fabric is treated by means of heatsetting such that the previously set transverse and longitudinal dimensions are maintained owing to conveying performed with positive driving and not by means of pulling. The heatsetting is performed by means of exposure to an air flow at a preselected temperature and for a predetermined period of time, using a heat transfer process with a high heat exchange since the air flow passes through and/or strikes the fabric instead of simply passing over it, thus ensuring an equal degree of setting on both surfaces of the tubular fabric. During heatsetting, the side edges of the tubular fabric are guided and supported internally for keeping them extended and prevent squashing thereof and consequent permanent fixing of lateral folds.

The heatsetting treatment is performed at a temperature in a range of from 180 to 200° C. and, preferably, from 185 to 195° C., and for a time period in a range of from 20 to 50 sec and, preferably, from 30 to 40 sec. For example, heatsetting is performed at a temperature of 190° C. and for a time period of 35 sec.

Then the tubular fabric undergoes stabilisation in order to reduce the thermoplastic state of the fibre by means of lowering of its temperature (cooling immediately after heatsetting) while maintaining the previously set transverse and longitudinal dimensions. Finally, the tubular fabric is unloaded in a tension-free state by means of positive driving.

What is claimed is:

1. Apparatus for heatsetting a knitted fabric in tubular form, comprising:

a) means for feeding said tubular fabric, b) steam-treatment means designed to direct steam onto said tubular fabric, c) first flat expansion means capable of extending said tubular fabric in a substantially flattened form, with two superimposed surfaces, and causing said flattened tubular fabric to assume a preselected width, d) conveying means capable of feeding said flattened tubular fabric, e) heatsetting means capable of forming at least one air flow, at a preselected temperature, and associated with said conveying means, f) means for stabilizing said heatset tubular fabric, and g) rod-shaped guiding means associated with said conveying means and said heatsetting means, wherein h) said conveying means comprise a drum having a cylindrical side wall onto which said flattened tubular fabric is wound, and i) said rod-shaped guiding means have substantially annular form and are associated with said drum for supporting internally said side edges of said flattened tubular fabric wound onto said cylindrical side wall, owing to the action of said heatsetting means, while keeping said side edges extended, leaving said superimposed surfaces free to be passed through by said air flow and keeping said width of said flattened tubular fabric unchanged.

2. Apparatus according to claim 1, further comprising second flat expansion means, said first flat expansion means and said second flat expansion means being located respectively upstream and downstream of said conveying means, said second flat expansion means being capable of keeping said tubular fabric in a substantially flattened form, with two superimposed surfaces, while maintaining said preselected width, said rod-shaped guiding means being connected to said first and second flat expansion means for assuming a mutual distance, equal to said width of said flattened tubular fabric.

3. Apparatus according to claim 1, wherein said heatsetting means are capable of directing said air flow towards said flattened tubular fabric for passing through and strike said two superimposed surfaces.

4. Apparatus according to claim 1, wherein said rod-shaped guiding means are formed by two rods with a curvilinear cross-section.

5. Apparatus according to claim 2, wherein said two rods are integral with said first and second flat expansion means for assuming said mutual distance and slider means are associated with said two rods for keeping them at said mutual distance with respect to said cylindrical side wall.

6. Apparatus according to claim 1, wherein said cylindrical side wall of said drum is perforated and said heatsetting means form substantially radial air flows, at a preselected temperature, capable of passing through said perforated wall and passing through and striking said two superimposed surfaces of said flattened tubular fabric for performing said heatsetting while said tubular fabric is wound onto said perforated drum.

7. Apparatus according to claim 2, characterized in that said two rods are integral with said first and second flat expansion means for assuming said mutual distance.

8. Apparatus according to claim 4, wherein slider means are associated with said two rods for keeping them at said mutual distance with respect to said cylindrical side wall.

9. Apparatus according to claim 1 wherein said drum is capable of feeding said fabric with positive driving, without applying a longitudinal tension.

10. Apparatus for heatsetting a knitted fabric in tubular form, comprising:

a) means for feeding said tubular fabric, b) steam-treatment means designed to direct steam onto said tubular fabric, c) first flat expansion means capable of extending said tubular fabric in a substantially flattened form, with two superimposed surfaces, and causing said flattened tubular fabric to assume a preselected width, d) conveying means capable of feeding said flattened tubular fabric, said conveying means comprising a drum having a cylindrical side wall onto which said flattened tubular fabric is wound, e) heatsetting means capable of forming at least one air flow, at a preselected temperature, and associated with said conveying means, f) means for stabilizing said heatset tubular fabric, and g) rod-shaped guiding means associated with said conveying means and said heatsetting means for supporting the tubular fabric while the tubular fabric is wound on said dram and passed through by the at least one air flow.

11. Apparatus according to claim 10, also comprising second flat expansion means, said first flat expansion means and said second flat expansion means being located respectively upstream and downstream of said conveying means, said second flat expansion means being capable of keeping said tubular fabric in a substantially flattened form, with two superimposed surfaces, while maintaining said preselected width, said rod-shaped guiding means being connected to said first and second flat expansion means for assuming a mutual distance, equal to said width of said flattened tubular fabric.

12. Apparatus according to claim 11, wherein said two rods are integral with said first and second flat expansion means for assuming said mutual distance and slider means are associated with said two rods for keeping them at said mutual distance with respect to said cylindrical side wall.

13. Apparatus according to claim 10, wherein said heatsetting means are capable of directing said air flow towards said flattened tubular fabric for passing through and strike said two superimposed surfaces.

14. Apparatus according to claim 15, wherein slider means are associated with said two rods for keeping them at said mutual distance with respect to said cylindrical side wall.

15. Apparatus according to claim 10, wherein said rod-shaped guiding means are formed by two rods with a curvilinear cross-section, said two rods having substantially annular form and being associated with said drum for supporting internally said side edges of said flattened tubular fabric wound onto said cylindrical side wall, owing to the action of said heatsetting means, while keeping said side edges extended, leaving said superimposed surfaces free to be passed through by said air flow and keeping said width of said flattened tubular fabric unchanged.

16. Apparatus according to claim 10 wherein said cylindrical side wall of said drum is perforated and said heatsetting means form substantially radial air flows, at a preselected temperature, capable of passing through said perforated wall and passing through and striking said two superimposed surfaces of said flattened tubular fabric for performing said heatsetting while said tubular fabric is wound onto said perforated drum.

17. Apparatus according to claim 10 wherein said drum is capable of feeding said fabric with positive driving, without applying a longitudinal tension.

18. Apparatus for heatsetting a knitted fabric in tubular form comprising:

a heatsetting chamber;

a rotating drum situated in the heatsetting chamber for conveying the knitted fabric in flattened tubular form in the heatsetting chamber, the rotating drum having a cylindrical side wall onto which the knitted fabric in flattened tubular form is wound;

two guide rods which extend in an essentially annular path around the cylindrical side wall of the drum and which internally support side edges of the knitted fabric in flattened tubular form wound around the cylindrical side wall of the drum, the two guide rods being spaced apart in a width direction of the knitted fabric in tubular form, the width direction being parallel to a major central axis of the drum.

19. The apparatus of claim 18, wherein a separation distance in the width direction by which the two guide rods are spaced apart is selectively adjustable.

20. The apparatus of claim 18, wherein the two guide rods have an essentially round cross section, whereby the two guide rods maintain the side edges of the knitted fabric in an extended and rounded form for preventing flattening or creasing of the side edges of the knitted fabric.

* * * * *